United States Patent [19]

Deakyne

[11] Patent Number: 4,991,757

[45] Date of Patent: Feb. 12, 1991

[54] SOCK APPLYING DEVICE

[76] Inventor: Ralph V. Deakyne, Millcroft Apt. 120, 255 Possum Park Rd., Newark, Del. 19711

[21] Appl. No.: 483,388

[22] Filed: Feb. 22, 1990

[51] Int. Cl.[5] ..... A47G 25/90

[52] U.S. Cl. ..... 223/112; 223/111

[58] Field of Search ..... 223/111, 112, 118; 24/489, 498, 562

[56] References Cited

U.S. PATENT DOCUMENTS

| | | | |
|---|---|---|---|
| 2,828,057 | 3/1958 | MacLauchlan | 223/111 |
| 3,204,636 | 9/1965 | Kariher | 24/562 |
| 3,401,856 | 3/1968 | Berlin | 223/111 |
| 3,452,907 | 7/1969 | MacLauchlan | 223/111 |
| 3,806,008 | 4/1974 | DeLettre | 223/111 |
| 4,130,226 | 12/1978 | Farrell | 223/111 |
| 4,637,532 | 1/1987 | Doorenbos | 223/111 |
| 4,651,909 | 3/1987 | Banting | 223/111 |

FOREIGN PATENT DOCUMENTS

| | | | |
|---|---|---|---|
| 6801 | of 1911 | United Kingdom | 24/498 |

OTHER PUBLICATIONS

1988 Professional Health Care Catalog, p. 58.

*Primary Examiner*—Werner H. Schroeder
*Assistant Examiner*—Bibhu Mohanty
*Attorney, Agent, or Firm*—Connolly & Hutz

[57] ABSTRACT

A sock applying device includes a flexible sheet generally shaped as a shovel blade. A plurality of fasteners are along one end of the sheet remote from the tip. The sheet includes registry notches to limit the extent to which a sock would be pulled over the sheet. Pull cords are provided along the same edge as the fasteners. In use, the sheet would be bent between the user's thighs with the tip uppermost. The sock would be pulled over the tip until the open end of the sock is in the registry notches. The fasteners would then be applied to the sock and the device would be placed on the floor so that the user could insert the user's foot into the device and pull the sock onto the foot by an upward pull of the cords.

30 Claims, 5 Drawing Sheets

Fig. 12.
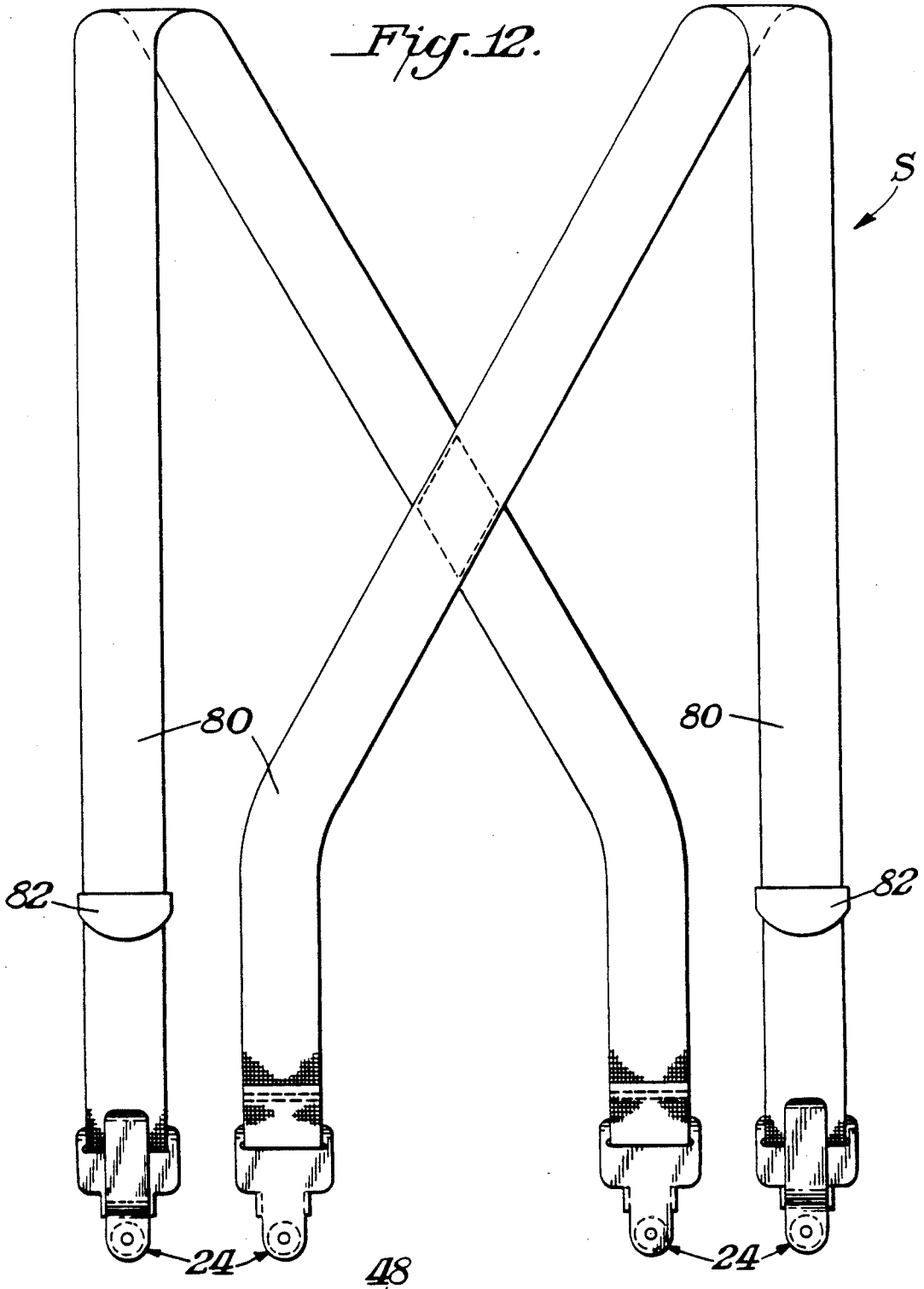
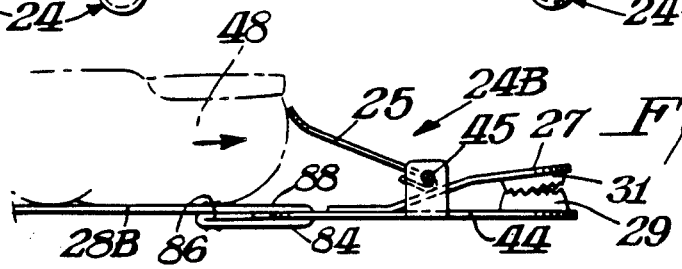
Fig. 9.

SOCK APPLYING DEVICE

Field of the Invention

This invention relates to a device for assisting disabled people in pulling socks or stockings on their feet.

BACKGROUND OF INVENTION

Elderly and disabled people often encounter problems in putting on stockings. This problem occurs because age or injuries limit this group's ability to bend over far enough or to lift the leg to place a stocking over their toes and pull it up over the heel and instep of their feet. Their limited ability to bend or lift the leg can be due to obesity, arthritis, generalized frailty or disabling injuries. People with this problem may be reduced to wearing shoes without socks or stockings or finding an aid or device that will assist them in pulling stockings on their feet.

Others who must use elastic stockings sometimes find them difficult to pull on because of their inability to bend and also because the elasticity of the stocking makes it difficult to pull them on.

A number of prior art devices have been reported but each of them fails to provide an adequate solution to the problem herein presented. Many of them are too complex for the simple task involved, while others err on the other side of being too simple so that they are ineffective in solving the problem as will be evident from the following.

U.S. Pat. No. 2,828,057 discloses a structure formed with a wire frame and platform shaped like a foot which is attached, at its rear, to twin handles and having one end of a pair of straps on the handles. The other end of the straps are attached to the top of a stocking which has been stretched over the wire frame and platform. A two step process is involved in its use. The user first places his foot in the cavity formed when the stocking is stretched over the wire frame and platform. Thereafter the user pulls the stocking on by means of the straps attached to the stocking. So a two step process is involved in its use. The device is also complex involving hinges, long handles, straps, wire frames and a metal platform. It is also heavy and clumsy.

U.S. Pat. No. 3,401,856 is a much simpler device than the previously mentioned one. It involves a tubular or "U" shaped cylindrical shape of some length having a pair of holes on one end and on each side of the "U". A line is anchored in each hole and is the means of pulling the cylinder with a stocking onto the foot of the user. As in the previous device, a user puts his foot in the cavity formed by inserting about half the length of the chordal truncated cylinder into the stocking. It is clear that this device will often fail in pulling on a stocking. Since the stocking is merely slid onto the truncated cylinder of the device and there are no means for insuring that the stocking is held in place. Thus, when the user pulls on the cord attached to the cylinder the stocking will be blocked by a person's instep and fall off the device. The user will have to try again.

U.S. Pat. No. 3,452,907 is very similar to the above mentioned U.S. Pat. No. 2,828,057 and substitutes a pliable material for the metal platform and wire frame part of the device. The same objections as to complexity and clumsiness apply to this device and the two step process for pulling on a stocking.

U.S. Pat. No. 3,806,008 is a Y-shaped tool which has hooks inside the "Y". These hooks engage the top edge of a stocking and thereby hold the stocking with its top open so a foot can be inserted in the stocking. Thereafter the tool is used to pull the stocking over a person's instep, held and ultimately up their calf. The device still requires the user to reach to the tip of his foot. This limitation would make it unsuitable for many who are not able to reach their toe with the tool.

U.S. Pat. No. 4,130,226 is a complex device employing a hoop attached near the end of a rod. A handle is located on the other end of the rod. The hoop has clamps located around its periphery which hold the opening of a stocking on the hoop so a foot can be stuck into the stocking. After clamping the top opening of a stocking to the hoop, the user then grasps the device with the handle, and places the stocking opening in front of this foot so he can then place his foot in the stocking and then he pulls the stocking up. The hoop can be placed varying distances from the handle so that it provides a long reach for those who need it. The main problem with the device is that it does not hold the stocking foot open so that the entire stocking must be forced over the person's foot. This limits the usefulness of the device to rather loose stockings.

U.S. Pat. 4,637,532 is a device used to put on elastic stockings. It functions primarily to force an elastic stocking open and hold it open while a foot is pushed into it. It does not provide any assistance in pulling the stocking on further after it has been placed on a person's foot. It would be useless for a person who cannot bend over far enough to grasp the top of the stocking.

U.S. Pat. No. 4,651,909 is a flexible spoon shaped sheet having cut out ear-like section on the blunt end. The flexible spoon is forced into a "U" shape then a stocking is forced onto it. The "ears" each have a cord attached to them and after a person's foot is inserted into the stocking opening, the person draws the stocking onto his foot with the cord. The main defect in this device is that there is no means for holding the stocking on the device and as soon as the user starts pulling on the device, it can slide out of the stocking leaving it on the person's toes.

A further known device distributed by Fred Sammonds, Inc. is known as "Economy Plastic Sock And Stocking Aid" ("Aid"). This device consists of a fashioned flexible polyethylene plastic sheet approximately 1/16 by 8¼ by 10 inches that can be bent into a half tube to receive the foot. The device includes two pull cords along the upper edge. The user draws the sock over the Aid and then inserts the foot. The cord is pulled to bring the sock onto the foot and around the heel. The drawbacks with the Aid device include encountering resistance of the heel of the foot to the sock as well as resistance of the instep of the foot to the sock. Additionally, the Aid does not control the position of the sock on the Aid. Further, two hands are required to use the Aid.

SUMMARY OF INVENTION

An object of this invention is to provide a sock applicating device or sock puller which overcomes the disadvantages of the prior art.

A further object of this invention is to provide such a device which in one embodiment thereof may be applied with only one hand thereby permitting its use with one-armed users.

In accordance with this invention, the sock applying device includes a shovel shaped sheet of flexible material having a rounded tip and having cutouts near the remote end of the shovel shape to define a pair of ears or lobes. Just below each ear is a small registry notch which engages the top edge of a sock placed on the sheet. Mounted on the remote end of the shovel shaped flexible sheet are a pair of cords which are used to pull the sheet and its sock mounted on the sheet onto the user's foot. Also mounted on the remote end of the sheet is at least one fastener which engages a sock which has been positioned on the sheet to assure the sock being pulled up onto the foot of the user. The process of using the device involves the user holding the flexible shovel shaped sheet between the user's thighs and forcing it into a "U". While holding the sheet in this way, the user pulls a sock over the shovel shaped tip end of the sheet. The top edge of the sock is pulled within the two notches located below the ears. The remaining part of the sock gathers along the length of the sheet. The fasteners located on the ears are then manually attached to the top edge of the sock. The bent sheet with its mounted sock is next placed on the floor with the "U" of the flexible sheet facing upward. The sheet and the mounted sock form a cavity into which the user places the user's foot. Then the user grasps the two cords attached to the rearward or remote end of the shovel shaped flexible sheet and in one motion, pulls the sock on the foot. The fasteners keep the sock from slipping off the sheet and assist in pulling the sock over the user's instep and heel.

In a further embodiment of this invention, a cutout is formed in the sheet midway between and in line with the two registry notches. Three equally spaced fasteners are provided along the upper edge of the sheet. Each ear has one of fasteners with the third fastener being located between the other ears along the longitudinal centerline of the sheet and in line with the cutout. With the practice of this embodiment, after the sock has been pulled onto the bent sheet, the end fasteners are attached with one hand and the center fastener can also be attached with one hand by the central cutout providing access to the sock. In this embodiment, a single pull cord would be used connected at each free end along the upper edge of the sheet. The fasteners are of the type which can be manipulated by a single hand. Accordingly, this embodiment may be practiced by a one-armed user since only a single hand is required to use the device.

THE DRAWINGS

DETAILED DESCRIPTION OF THE INVENTION

Figure 1:
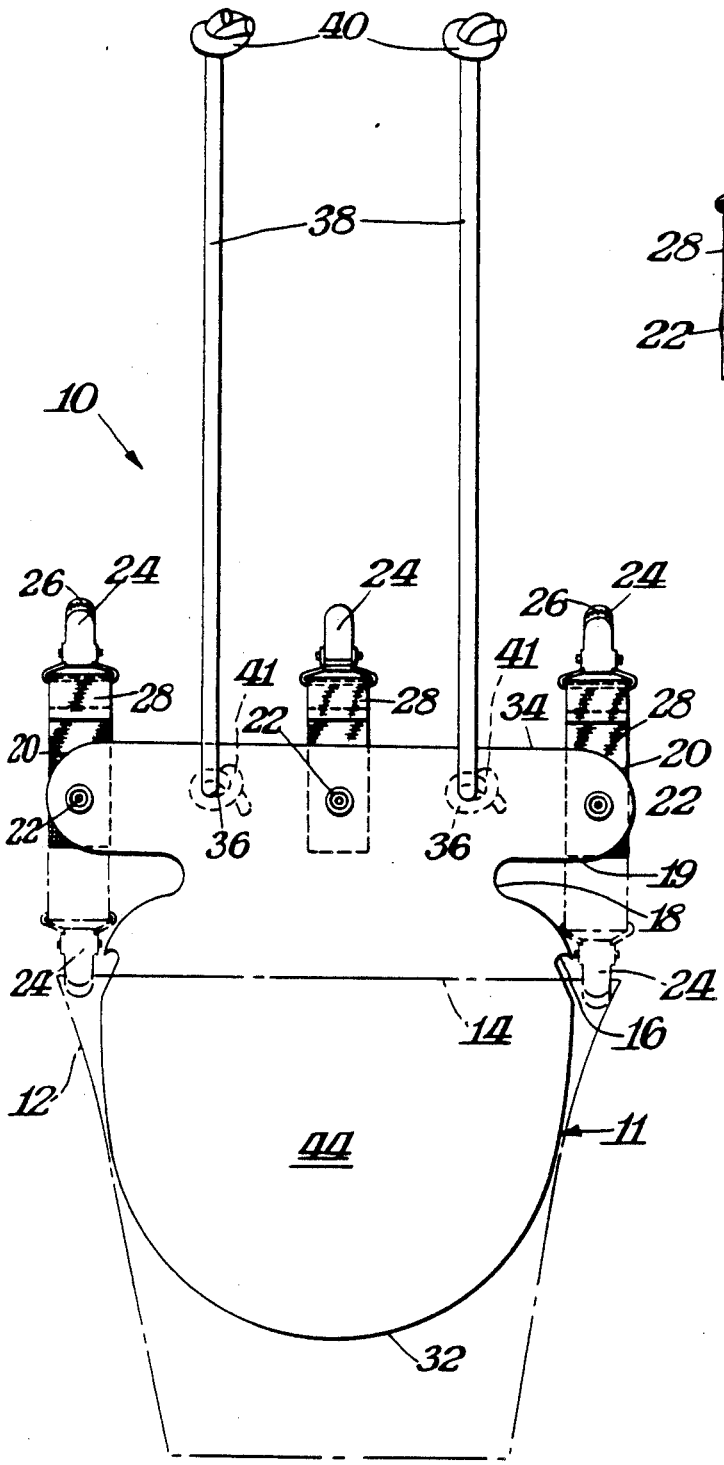
FIG. 1 is a front elevational view of the sock applicating device of this invention with a sock shown in phantom outline and with two of the grasping clips shown in phantom engaging the top of the sock.

FIG. 1 shows the stocking puller or sock applicating device generally as 10. Applicating device 10 includes a flexible shovel shaped sheet 11 having a rounded tip 32 with a pair of ears or lobes 20 formed at the remote end of sheet 11. A pair of registry notches 16 are formed on opposite sides of sheet 11 between the cutouts 18 which create the ears and the rounded tip 32. A plurality, preferably three, fasteners 24 are provided on the remote end of sheet 11. Fasteners 24 are mounted in such a manner that they can be detachably connected to the upper edge 14 of sock 12. For example, fasteners 24 may include a strap 28 having a clip or buckle 26 at the end thereof rotatably mounted by a snap fastener on rivet 22. In addition, device 10 includes a pair of pull cords 38 secured to the remote end of sheet 11.

Figure 11:
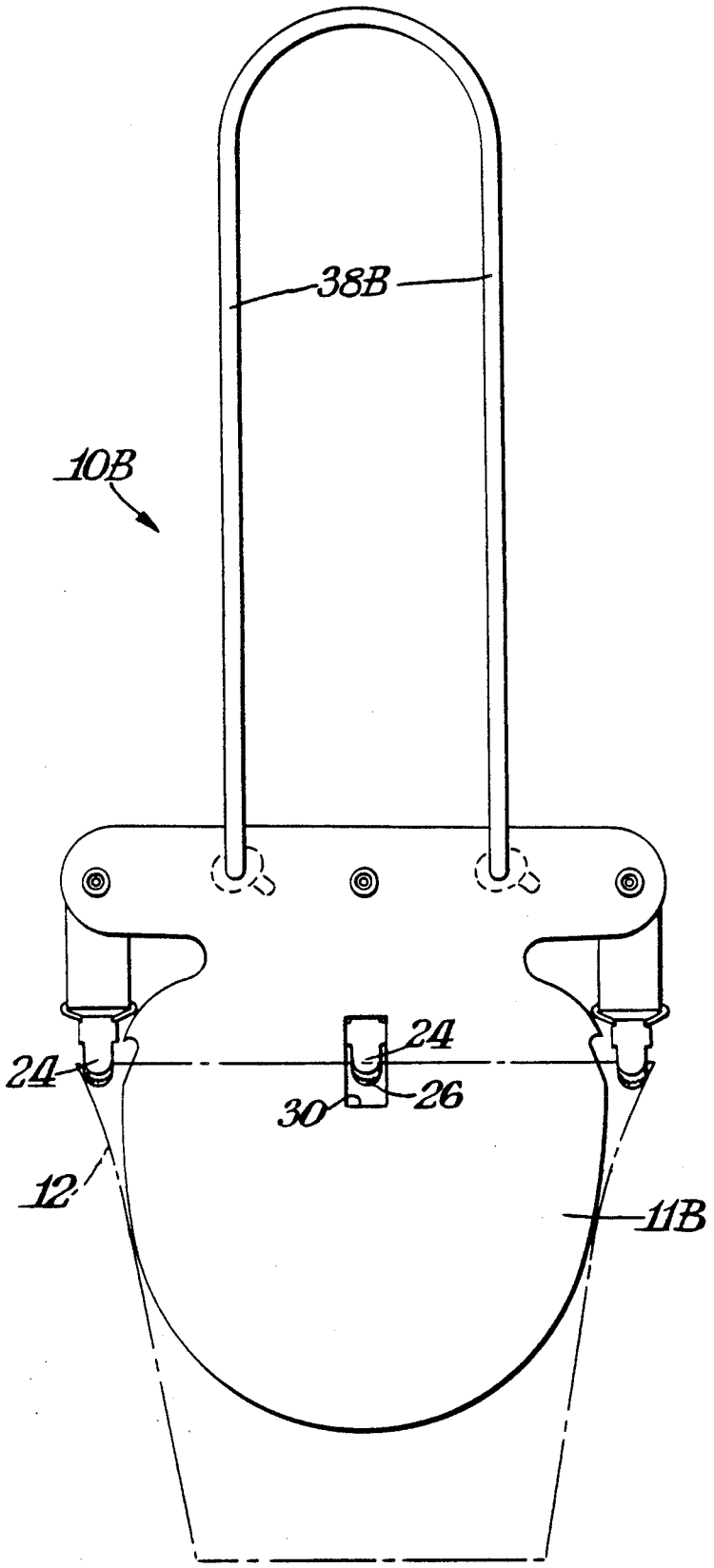
FIG. 11 is a front elevational view of a modified sock applicating device in accordance with this invention.

As illustrated in FIG. 1, the flexible shovel shaped sheet 11 has a sock 12 mounted on it with its top edge 14 positioned in the notches 16. Ears or lobes 20 are shaped in the device by removing the material in the cut outs 18. The edge 19 of the cut out 18 is about two (2) inches from the rear edge 34 of the stocking puller 10. The sock 12 is first pulled over the forward end or rounded tip 32 of the stocking puller 10 as will be shown in more detail in the figures. Each elastic strap 28 is attached at one end to a clip or buckle 26 and attached at the other end to the flexible shovel shaped sheet 11 by means of rivets 22. Rivets 22 permit straps 28 to rotate and permit straps 28 to be detached. The middle fastener 24 is located on the longitudinal centerline of the shovel shaped sheet 11. A hole 36 is located midway between each set of rivets 22 and through these holes 36 is passed a pulling rope or cord 38 which is held in place with knots 41 on the ends of the rope 38 or in any suitable manner. While FIG. 1 shows two ropes 38 a single continuous rope with two knots on its ends after being pushed through the hole 36 can also be used as shown in FIG. 11. The stocking puller or applicating device 10 has two sides, a bottom side 42 which faces downward when in use and a top side 44.

Figure 3:
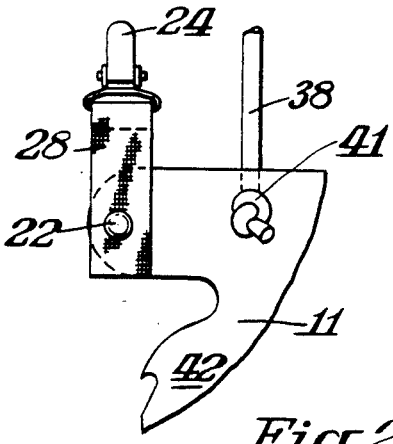
FIG. 3 is a fragmented rear elevational view of a fastener and the knotted end of the pulling cord of the device of FIGS. 1–2.
Figure 2:
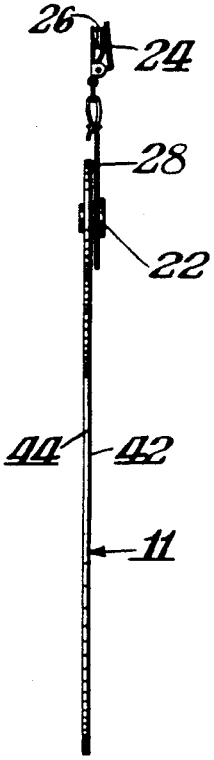
FIG. 2 is a side elevational view of the device of FIG. 1.

FIG. 3 shows some of the details of the bottom side 42 of the sheet 11 with the knot 41 and the rivet 22 shown holding an outside grasping clamp or fastener 24 and its elastic strap 28 onto the ear 20 of the flexible sheet 11.

Figure 4:
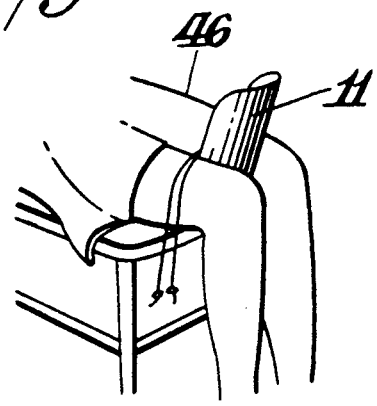
FIG. 4 is a pictorial view showing the initial placement of the sock applicating device between the knees or thighs of the user.
Figure 5:
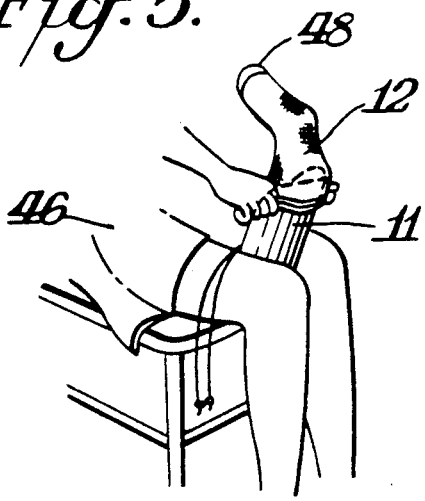
FIG. 5 is a pictorial view showing a sock being slipped onto the sock applicating device.
Figure 6:
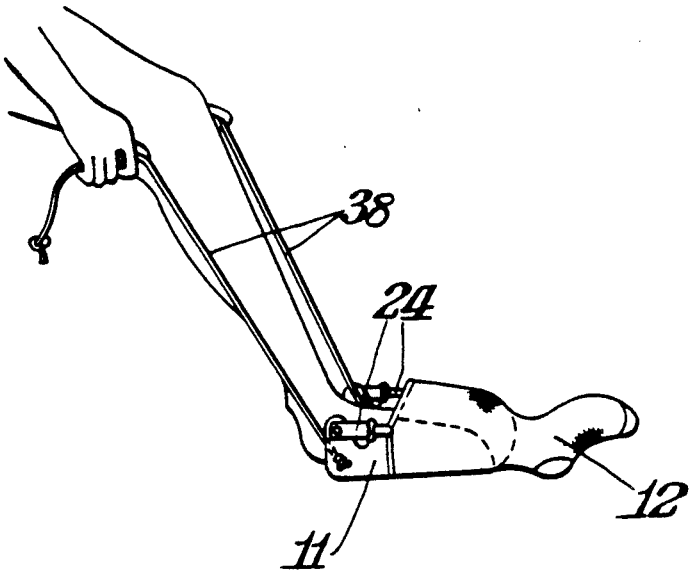
FIG. 6 is a pictorial view showing the placement of the sock applicating device with its mounted sock just before it is pulled onto the user's foot.

FIGS. 4-6 show the stocking puller or device 10 in use. In FIG. 4 the flexible shovel shaped sheet 11 is placed between the knees or thighs of a user who applies pressure sufficient to curl the sheet 11 into a U-shape with end 32 uppermost.

In FIG. 5 the user 46 is shown pulling a sock 12 onto the flexible sheet 11. The bottom side 42 of the flexible sheet 11 faces away from the user 46 and the top side 44 faces toward the user 46. The toe 48 of the sock 12 is positioned so that it is closest to the user 46. The sock is pushed on to sheet 11 until only the toe portion is unsupported. This orientation of the stocking puller 10 will place the fasteners 24 in the proper position so they can be attached to the top edge 14 of the sock. The position of the toe 48 will result in its being in the correct orientation when the sock 12 is pulled on the user 46. The sock 12 is pulled down onto the flexible sheet 11 until the top edge 14 of the sock 12 is placed in the notches 16. It is important that the sock not be pulled to cutouts 18 which would make it too difficult to insert the foot into the sock. At this point the fasteners 24 are attached to the top edge 14 of the sock 12. The middle fastener 24 is aided in grasping the top 14 of the sock 12 by the user pulling the sock away from sheet 11 with one hand and manipulating the buckle 26 with the other hand so that both jaws of the buckle can easily grasp the top 14 of the sock 12.

As shown in FIG. 6, the sock 12 mounted on the stocking puller 10 is now placed on the floor and the user 46 holds the ropes or cords 38 and places the user's foot into the cavity or open tube formed by the stocking puller 10 being held in a U-shape by the sock 12. Pulling on the two ropes 38 results in the top edge 14 of the sock 12 being pulled over the instep and heel and up the calf of the user 46. The user accomplishes the pulling on of the sock in one motion. When the sock is in place with the remote end of sheet 11 near the knees, the user detaches fasteners 24. Device 10 can then be removed leaving sock 12 in place.

Sometimes it is necessary to put two pair of socks or stockings on a user. The stocking puller 10 successfully pulled a second sock over another sock already on the user's foot. This shows the efficiency of the stocking puller 10.

Among the notable features of device 10 is that sheet 11 includes rounded surfaces at its lead end 32 which act in a manner similar to a cam in facilitating the sock being slid onto the bent sheet. Another important feature is that the distance between the registry notches 16 is greater than the distance between cutouts 18. This is important in that the cutouts 18 provide greater flexibility by creating ears or lobes 20 which must be bent for proper positioning in securing the fasteners to the sock. On the other hand, if the sock were pulled upwardly so that it was engaged in cutouts 18, the resultant opening of the sock 12 would be so small that it would be difficult to insert a foot. Accordingly, a greater distance is utilized between notches 16 to maximize the degree of opening of the sock once the sock is mounted on sheet 11. The straight but inwardly converging sides of notches 16 also facilitate the proper mounting or locating of the sock on sheet 11 in connection with the shoulders formed at the ends of notches 16. In this respect as shown in FIG. 1, rounded tip 32 is formed along a smooth arc which merges into generally straight but slightly diverging edges immediately before the beginning of notches 16. The diverging edges then merge into straight converging edges which merge into rounded edges and then straight diverging edges generally parallel to the converging edges so as to form shoulders in the notches 16 to effectively limit the extent to which sock 12 may be pulled onto sheet 11.

In a preferred practice of this invention, straps 28 are elastic or stretchable. The invention, however, may be practiced with the straps being non-elastic since the fasteners 24 can still be properly positioned by being spaced from the pivot points provided by rivets 22 a length sufficient to position the clamps 26 of fasteners 24 at the top 14 of sock 12.

The sock puller 10 of this invention effectively overcomes the problems encountered with prior devices. For example, the prior art Aid has the problem of not coping with the resistance of the heel and the foot of the sock. This is solved with the device 10 of this invention by using a "pants suspender" toggle-type clasp or buckle 26 with a woven elastic strap 28 approximately 1 $\frac{1}{8}$ by 3 inches fastened to the backside on the centerline near the top of sheet 11 with a heavy-duty snap fastener. In operation, when the buckle 26 is clipped on the back top edge 14 of sock 12, a pull on the cords 38 will pull the sock 12 over the heel of the foot.

A further problem encountered with the prior art Aid is the inability to cope with the resistance of the instep of the foot to the sock. This problem is solved by the invention in that the device 10 permits the top edge 14 of the sock to be grasped over the center of the instep of the foot and then permit a pulling on that location. By having the lobes or ears 20 extended a sufficient amount at the corners of sheet 11, it is possible to approach the center of the instep of the foot when sheet 11 is bent into a half tube shape. The extension of the ears 20 with the addition of the fasteners allow the lines of force to come close enough to the center line of the instep to pull the sock over the instep of the foot.

A further problem with prior art Aid is the lack of ability to control the position of the sock on the device. With the present invention, it is possible to prevent the top of the sock from coming into the large notches 18 of the device. This is done by providing the notches 16 on each side of sheet 11 below the large notches or cutouts 18. The illustrated curvature of sheet 11 in the area of notches 16 also assure that the sock will be prevented from riding up and out of the notches 16.

In the exemplary embodiment of the invention illustrated in FIG. 1, sheet 11 is made of a fashioned flexible polyethylene plastic material about 1/16 inch thick by 10 $\frac{3}{8}$ inches wide and 10$\frac{3}{8}$ inches long. Sheet 11 can be bent into a half tube shape to receive the foot as previously described. In this embodiment, two braided polyethylene pull cords 38 are 28 inches long by 5/16 inch in diameter which are threaded through holes 36, $\frac{3}{8}$ inches in diameter. Three "pants suspenders" toggle-type clips 26 with woven elastic straps 28 are used wherein each strap is approximately 1$\frac{1}{8}$ inch by 3 inches fastened to the top backside at the centerline of sheet 11 and to the lobes or ears 20 on each side of sheet 11 with heavy duty type snap fasteners. The use of snap fasteners is an advantageous feature since it permits the detachment of the grasping devices to permit those devices to be cleaned, repaired or replaced and also permits straps 28 to rotate about rivets 22. The large notches or cutouts 18 on each side of sheet 11 near the top add flexibility and allow the two fasteners 24 on the side ears to reach the sock near its top center. As previously noted, the two small notches 16 are located below cutouts 18 and hold the sock in position. The vertical lines or straight surfaces in the small notches 16 merge into curves. These curves restrain the top of the sock thus preventing it from riding up and out of the notches 16.

Figure 7:
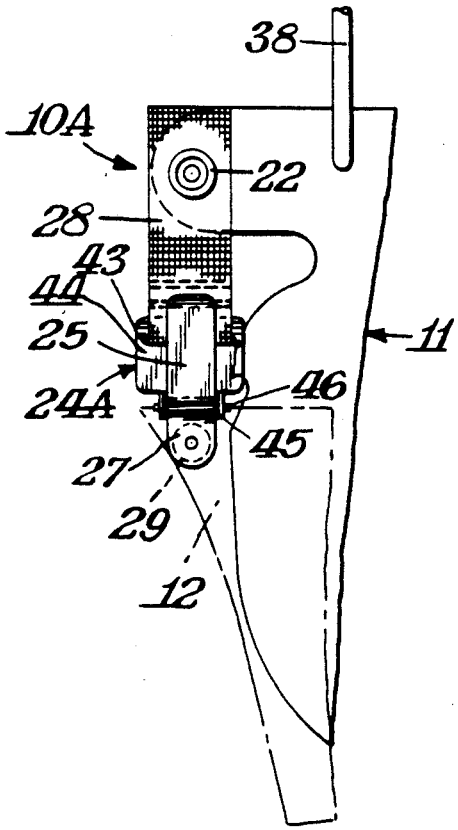
FIG. 7 is a fragmented front elevational view showing a fastener usable with this invention.
Figure 8:
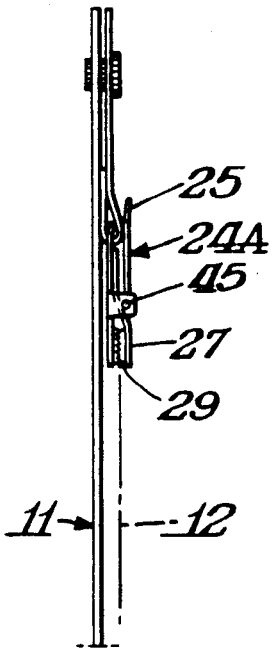
FIG. 8 is a side elevational view of the fastener shown in FIG. 7.
Figure 9:
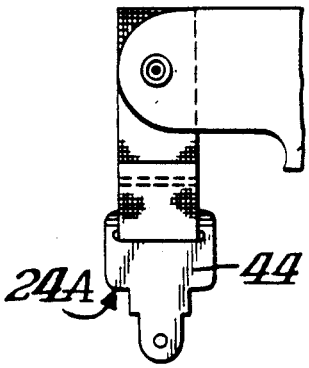
FIG. 9 is a rear elevational view of the fastener shown in FIGS. 7–8.
Figure 10:
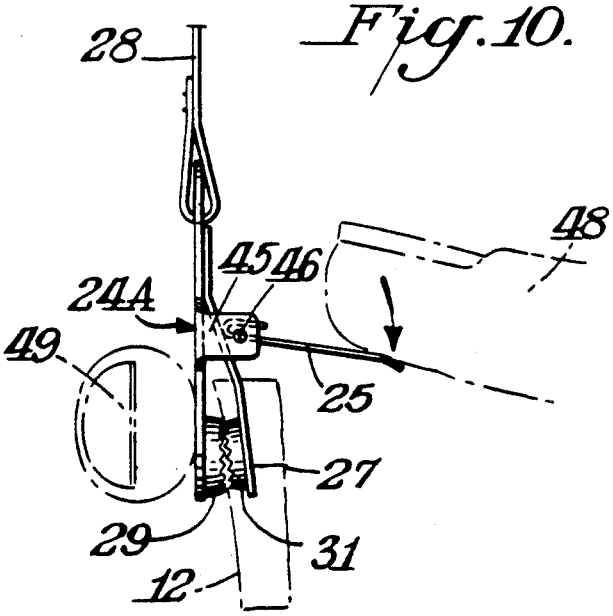
FIG. 10 is a side elevational view of the fastener shown in FIGS. 7–9 during one step of its operation.

FIGS. 7–10 illustrate a fastener 24A in accordance with invention which is particularly designed for one-handed operation. As shown therein, fastener 24A on device 10A includes elastic strap 28 pivotally mounted on snap fastener rivet 22. Strap 28 is secured through a slot 43 in plate 44. As best shown in FIGS. 9–10, plate 44 is generally T-shaped and includes a pair of flanges 45 which are bent upwardly 90 degrees to provide a set of parallel walls. As shown in FIGS. 7 and 10, extensions 46 from actuating lever 25 are mounted in aligned holes in walls 45. The grasping or clamping mechanism includes a toothed clamp member 29 disposed for contact by a second toothed clamp member 31 on spring arm 27 as most clearly shown in FIG. 10. The provision of sidewards extensions or projections 46 of lever 25 provides a fulcrum for the forefinger 49 so that the thumb 48 will have something to push against to open and close the clamp members 29, 31 of the fastener. As shown, for example, in FIG. 10, actuating lever or handle 25 terminates in a curled or bent end to facilitate the operation of the handle and increase its capacity. The bent or curled end facilitates actuation of lever 25 when lever 25 rests on strap 28 as shown in FIG. 8. Lever 25 is of extended length such as 1⅜ inches long. This extended length increases the power of the handle and the ease of operating the grasping means. In effect the handle is reversed from the conventional structure thereby making it easier to operate by achieving and maintaining the full power of the 90 degree angle of the bit to the jaw progressively and reaching the maximum pressure or bite at the closed portion of the buckle. The fulcrum end of lever 25 selectively presses against or releases spring arm 27 to open or close the fastener. This construction also allows the handle to be operated easily by the thumb 48 of one hand while using the forefinger 49 of the same hand as a fulcrum under the lower jaw or plate 44 to push against. The upper spring arm 27 is also lengthened and has a 20 degree offset bend in it to allow for the opening of the jaws. The spring arm 27 may be riveted to the lower jaw 44 or as illustrated may be spot welded. The fastener shown in FIGS. 7–10 best represents a modification of, for example, a commercial-type suspender buckle having plastic teeth. This modification includes, for example, extending the length and width of the various components and reversing the direction of operation of the handle or lever. Jaws 29, 31 are closed when lever 25 is pivoted against strap 28 and are opened when lever 25 is pivoted against spring 27.

FIG. 11 illustrates a puller or applicating device 10B which is particularly adapted for use by one-handed or other handicapped people having the use of only a single hand. Device 10B is similar in construction to device 10 and accordingly like numerals are used for like parts. The main differences between device 10B and device 10 is that device 10B includes a single pull cord or rope 38B so that a single hand would cause a force to be exerted on both sides of sheet 11B. A further significant difference of device 10B is the inclusion of a cutout 30 spaced along the longitudinal centerline of sheet 11B in line with notches 16. Cutout 30 is suitably dimensioned such as being 1¼ by ⅝ inches. The provision of cutout 30 is necessary for one-armed users. In this respect where there is no cutout two hands are required to attach the center fastening clip 26. In this regard, where there is no cutout one hand must be used to pull the sock away from sheet 11 thereby providing access for the buckle 26 of fastener 24 which in turn would be manipulated by the other hand. The presence of hole 30, however, allows access to the edge 14 of sock 12 in the area of the center fastener to permit the user to manipulate the clamp and fasten it to the sock through the types of manipulations described in connection with fastener 24A of FIGS. 7–10 without requiring a second hand to stretch the sock away from sheet 11B.

Although device 10B is intended for operation by a user having the ability to use only one hand, it is obvious that the device may be used by user's having the use of both hands.

As can be appreciated, the invention thereby provides an effective manner of applying a sock or stocking to a user without the user having to bend or lift the foot, yet apply the sock directly on the foot. Accordingly, the manner of inserting the sock initially on the device 10 is accomplished by manipulations with the device in the user's lap. The device is then placed on the floor with the sock held in place in an open condition and the user need only insert the foot and then pull upwardly on the cord to cause the sock to be applied to the foot. The upward pulling disposes the device at a sufficient elevation that it can be readily detached by the user without having to bend unnecessarily where the user is incapable or not permitted to make such bending.

What is claimed is:

1. A sock applicating device comprising a stiff, bendable sheet having a shovel-like shape with a rounded tip at its lead end and a remote end whereby a sock may be inserted over said lead end and pulled toward said remote end when said sheet is bent about its longitudinal centerline extending from said tip to said remote end, fastening means on said remote end for detachable securement to the sock when said sock is mounted on said bent sheet, registry means on said sheet between said tip and said fastening means for limiting the extent the sock is pulled on said bent sheet, pull cord means secured to said remote end whereby said bent sheet and sock may be placed on the floor and the user's foot may be inserted therein and the bent sheet and sock may be pulled up the foot until the sock is applied in place so that the sheet can be detached from the sock and be removed with the sock remaining on the foot, a cutout in each edge of said sheet at opposite sides thereof at said remote end to form an ear on each side of said sheet between said registry means and the remote edge of said remote end, said fastening means further including a buckle and strap connected to each of said ears, said fastening means including a buckle and strap connected to said remote end on said centerline and in line with and midway between said buckles and straps connected to said ears, each of said straps being rotatably and detachably connected to said sheet, each of said buckles comprising a plate connected to a respective strap, a lower clamping jaw fixed on said plate remote from said strap, a spring arm mounted to said plate, said spring arm having an upper clamping jaw movable toward and away from said lower clamping jaw, an actuating lever mounted to said plate remote from said clamping jaws, said lever having a free end disposed above said clamping jaws and extending beyond said spring arm, said lever being pivotally mounted to said plate whereby movement of said free end of said lever toward and away from said spring arm causes said clamping jaws to selectively move toward and away from each other, said clamping jaws being closed when said free end of said lever is pivoted away from said spring arm and said clamping jaws are opened when said free end of said lever is pivoted toward said spring arm whereby said lever may be manipulated to open and close said clamping jaws with a single hand of the user, said registry means comprising a notch in each edge of said sheet at opposite sides thereof at said remote end between a respective cutout and said tip, the distance between said notches being greater than the distance between said cutouts, a central cutout in said sheet on said centerline and in line with and midway between said notches, and said buckle of said centerline strap being able to be disposed at said central cutout.

2. A method of applying a sock to a user's foot comprising the steps of the user bending into a U-shape a stiff sheet having a shovel-like shape with a rounded tip and a remote end, the remote end being pressed between the user's thighs with the rounded tip extending upwardly, pulling a sock over the rounded tip toward the remote end whereby the bent sheet and mounted sock create an open tube, sliding the open edge of the sock along the smooth edge of the sheet upwardly from the tip until the open end of the sock slides into a single set of aligned registry notches in the remote end of the sheet, sets of fasteners being connected to the sheet between the registry notches and the remote end with each fastener comprising a strap connected to the sheet and a buckle connected to the strap at a distance generally equal to the distance from the point of connection of the strap to the location of the aligned registry notches, rotating each strap until its buckle is disposed at the open edge of the sock, attaching the buckles of the fasteners to the open edge of the sock, placing the open tube on the floor, the user inserting the user's foot into the open tube, pulling the open tube up the foot by means of cord means attached to the sheet with the sock passing over the instep and heel of the foot until the sock is properly positioned, disconnecting the buckles from the sock, and removing the sheet from the sock.

3. The method of claim 2 wherein the fastening and detachment of the buckles is done with one hand.

4. A sock applicating device comprising a stiff, bendable sheet having a shovel-like shape with a rounded tip at its lead end and a remote end whereby a sock may be inserted over said lead nd and pulled toward said remote end when said sheet is bent about its longitudinal centerline extending from said tip to said remote end, a cutout in each edge of said sheet at opposite sides thereof at said remote end to form an ear on each side of said sheet, fastening means on said remote end for detachable securement to said sock when the sock is mounted on said bent sheet, a registry notch on each edge of said sheet between said tip and a respective cutout for limiting the extent the sock is pulled on said bent sheet, each of said registry notches opening toward said rounded tip, said registry notches being aligned with each other, said edge of said sheet being smooth and uninterrupted from said rounded tip to said registry notches, the depth of each of said notches into said sheet being less than the depth of each of said cutouts into said sheet, and pull cord means secured to said remote end whereby said bent sheet and sock may be placed on the floor and the user's foot may be inserted therein and the bent sheet and sock may be pulled up the foot until the sock is applied in place so that the sheet can be detached from the sock and be removed with the sock remaining on the foot.

5. The device of claim 4 wherein said fastening means includes a buckle and strap connected to each of said ears.

6. The device of claim 3 wherein said fastening means comprises three aligned sets of buckles and straps, one of said sets being connected to each of said ears, and the remaining of said sets being connected on said centerline to said remote end.

7. The device of claim 6 including a central cutout in said sheet on said centerline and in line with and midway between said notches, and said buckle of said centerline strap being able to be disposed at said central cutout.

8. The device of claim 7 wherein said cord means comprises a single cord having a pair of free ends, each of said free ends of said cord being secured to said remote end of said sheet in line with and between a respective pair of said stages.

9. The device of claim 3 wherein said fastening means includes a buckle and strap connected to said remote end on said centerline and in line with and midway between said buckles and straps connected to said ears.

10. The device of claim 4 wherein each of said straps is rotatably connected to said sheet.

11. The device of claim 5 wherein each of said straps is detachably connected to said sheet.

12. The device of claim 6 wherein each of said straps is elastic.

13. The device of claim 6 wherein each of said buckles comprises a plate connected to a respective strap, a lower clamping jaw fixed on said plate remote from said strap, a spring arm mounted to said plate, said spring arm having an upper clamping jaw movable toward and away from said lower clamping jaw, an actuating lever mounted to said plate remote from said clamping jaws, said lever having a free end disposed above said clamping jaws and extending beyond said spring arm, and said lever being pivotally mounted to said plate whereby movement of said free end of said lever toward and away from said spring arm causes said clamping jaws to selectively move toward and away from each other.

14. The device of claim 8 wherein said plate includes a pair of flanges bent away from said plate to form a pair of walls, aligned holes in said wall, said actuating lever having a pair of projections disposed in said aligned holes to comprise the pivotal mounting of said lever to said plate, and said free end of said lever being bent toward said clamping jaws.

15. The device of claim 8 wherein said clamping jaws are closed when said free end of said lever is pivoted away from said spring arm and said clamping jaws are opened when said free end of said lever is pivoted toward said spring arm whereby said lever may be manipulated to open and close said clamping jaws with a single hand of the user.

16. The device of claim 4 wherein said cord means comprises a pair of cords, each of said cords having a pair of free ends, and one of said free ends of each of said free ends being secured to said sheet in line with and between a respective pair of said straps.

17. A sock applicating device comprising a stiff, bendable sheet having a shovel-like shape with a rounded tip at its lead end and a remote end whereby a sock may be inserted over said lead end and pulled toward said remote end when said sheet is bent about its longitudinal centerline extending from said tip to said remote end, fastening means on said remote end for detachable securement to the sock when said sock is mounted on said bent sheet, a set of linearly aligned registry means on said sheet between said tip and said fastening means for limiting the extent the sock is pulled on said bent sheet, said fastening means comprising buckle and strap assemblies, each strap of each assembly being connected by pivot means to said remote end, the length of each strap and its buckle from its pivot means to its buckle being generally equal to the distance between its pivot means and said registry means to automatically locate each buckle at the sock when said sock is positioned at said registry means, and pull cord means secured to said remote end whereby said bent sheet and sock may be placed on the floor and the user's foot may be inserted therein and the bent sheet and sock may be pulled up the foot until the sock is applied in place so that the sheet can be detached from the sock and be removed with the sock remaining on the foot.

18. The device of claim 17 including a cutout in each edge of said sheet at opposite sides thereof at said remote end to form an ear on each side of said sheet between said registry means and the remote edge of said remote end.

19. The device of claim 17 wherein said registry means comprises a notch in each edge of said sheet at opposite side thereof at said remote end between a respective cutout and said tip, and the distance between said notches being greater than the distance between said cutouts.

20. The device of claim 11 wherein each of said notches is formed by an inwardly disposed straight edge merging into a curved edge which merges into an outwardly disposed straight edge generally parallel to said inwardly disposed straight edge.

21. The device of claim 11 including a central cutout in said sheet on said centerline and in line with and midway between said notches, and said buckle of said centerline strap being able to be disposed at said central cutout.

22. The device of claim 13 wherein said cord means comprises a single cord having a pair of free ends, each of said free ends of said cord being secured to said remote end of said sheet in line with and between a respective pair of said straps.

23. The device of claim 17 wherein each of said straps is detachably connected to said sheet.

24. The device of claim 17 wherein each of said buckles comprises a plate connected to a respective strap, a lower clamping jaw fixed on said plate remote from said strap, a spring arm mounted to said plate, said spring and arm having an upper clamping jaw movable toward and away from said lower clamping jaw, an actuating lever mounted to said plate remote from said clamping jaws, said lever having a free end disposed above said clamping jaws and extending beyond said spring arm, and said lever being pivotally mounted to said plate whereby movement of said free end of said lever toward said spring arm causes said clamping jaws to selectively move toward and away from each other.

25. The device of claim 16 wherein said clamping jaws are closed when said free end of said lever is pivoted away from said spring arm and said clamping jaws are opened when said free end of said lever is pivoted toward said spring arm whereby said lever may be manipulated to open and close said clamping jaws with a single hand of the user.

26. The device of claim 17 wherein said registry means comprises a notch in each edge of said sheet at opposite side thereof at said remote end between a respective cutout and said tip, and the distance between said notches being greater than the distance between said cutouts.

27. The device of claim 18 including a central cutout in said sheet on said centerline and in line with and midway between said notches, and said buckle of said centerline strap being able to be disposed at said central cutout.

28. The device of claim 19 wherein said cord means comprises a single cord having a pair of free ends, each of said free ends of said cord being secured to said remote end of said sheet in line with and between a respective pair of said straps.

29. A sock applicating device comprising a stiff, bendable sheet having a shovel-like shape with a rounded tip at its lead end and a remote end whereby a sock may be inserted over said lead end and pulled toward said remote end when said sheet is bent about its longitudinal centerline extending from said tip to said remote end, fastening means on said remote end for detachable securement to the sock when said sock is mounted on said bent sheet, registry means on said sheet between said tip and said fastening means for limiting the extent the sock is pulled on said bent sheet, pull cord means secured to said remote end whereby said bent sheet and sock may be placed on the floor and the user's foot may be inserted therein and the bent sheet and sock may be pulled up the foot until the sock is applied in place so that the sheet can be detached from the sock and be removed with the sock remaining on the foot, a cutout in each edge of said sheet at opposite sides thereof at said remote end to form an ear on each side of said sheet between said registry means and the remote edge of said remote end, said fastening means further including a buckle and strap connected to each of said ears, said fastening means including a buckle and strap connected to said remote end on said centerline and in line with and midway between said buckles and straps connected to said ears, each of said buckles comprising a plate connected to a respective strap, a lower clamping jaw fixed on said plate remote from said strap, a spring arm mounted to said plate, said spring and arm having an upper clamping jaw movable toward and away from said lower clamping jaw, an actuating lever mounted to said plate remote from said clamping jaws, said lever having a free end disposed above said clamping jaws and extending beyond said spring arm, said lever being pivotally mounted to said plate whereby movement of said free end of said lever toward said spring arm causes said clamping jaws to selectively move toward and away from each other, said clamping jaws being closed when said free end of said lever is pivoted away from said spring arm and said clamping jaws are opened when said free end of said lever is pivoted toward said spring arm whereby said lever may be manipulated to open and close said clamping jaws with a single hand of the user, said registry means comprising a notch in each edge of said sheet at opposite sides thereof at said remote end between a respective cutout and said tip, the distance between said notches being greater than the distance between said cutouts, a central cutout in said sheet on said centerline and in line with and midway between said notches, and said buckle of said centerline strap being able to be disposed at said central cutout.

30. A sock applicating device comprising a stiff, bendable sheet having a shovel-like shape with a rounded tip at its lead end and a remote end whereby a sock may be inserted over said lead end and pulled toward said remote end when said sheet is bent about its longitudinal centerline extending from said tip to said remote end, fastening means on said remote end for detachable securement to the sock when said sock is mounted on said bent sheet, registry means on said sheet between said tip and said fastening means for limiting the extent the sock is pulled on said bent sheet, pull cord means secured to said remote end whereby said bent sheet and sock may be placed on the floor and the user's foot may be inserted therein and the bent sheet and sock may be pulled up the foot until the sock is applied in place so that the sheet can be detached from the sock and be removed with the sock remaining on the foot, a cutout in each edge of said sheet at opposite sides thereof at said remote end to form an ear on each side of said sheet between said registry means and the remote edge of said remote end, said registry means comprising a notch in each edge of said sheet at opposite sides thereof at said remote end between a respective cutout and said tip, the distance between said notches being greater than the distance between said cutouts, said fastening means comprising three aligned sets of buckles and straps, one of said sets being connected to each of said ears, and the remaining of said sets being connected on said centerline to said remote end, a central cutout in said sheet on said centerline and in line with and midway between said notches, and said buckle of said centerline straps being able to be disposed at said central cutout.

* * * * *